US010876725B1

(12) United States Patent
Lan et al.

(10) Patent No.: US 10,876,725 B1
(45) Date of Patent: Dec. 29, 2020

(54) HIGH-POWER LED BULB

(71) Applicant: SHENZHEN GUANKE TECHNOLOGIES CO., LTD, Shenzhen (CN)

(72) Inventors: Qing Lan, Shenzhen (CN); Tianlong Dai, Shenzhen (CN); Ligen Liu, Shenzhen (CN); Shoubao Chen, Shenzhen (CN); Wenhao Lin, Shenzhen (CN)

(73) Assignee: SHENZHEN GUANKE TECHNOLOGIES CO., LTD, Shenzhen (CN)

( * ) Notice: Subject to any disclaimer, the term of this patent is extended or adjusted under 35 U.S.C. 154(b) by 0 days.

(21) Appl. No.: 16/715,029

(22) Filed: Dec. 16, 2019

(30) Foreign Application Priority Data

Oct. 25, 2019 (CN) ..... 2019 2 1819870 U

(51) Int. Cl.

| | |
|---|---|
| ***F21K 9/238*** | (2016.01) |
| ***F21V 29/77*** | (2015.01) |
| ***F21V 29/83*** | (2015.01) |
| ***F21V 23/02*** | (2006.01) |
| *F21Y 105/18* | (2016.01) |
| *F21Y 115/10* | (2016.01) |
| *F21K 9/237* | (2016.01) |
| *F21K 9/235* | (2016.01) |

(52) U.S. Cl.
CPC ..... *F21V 29/773* (2015.01); *F21K 9/238* (2016.08); *F21V 23/02* (2013.01); *F21V 29/83* (2015.01); *F21K 9/235* (2016.08); *F21K 9/237* (2016.08); *F21Y 2105/18* (2016.08); *F21Y 2115/10* (2016.08)

(58) Field of Classification Search
CPC ..... F21K 9/235; F21K 9/237; F21K 9/238; F21V 23/02; F21V 29/733; F21V 29/83; F21Y 2103/30; F21Y 2103/33; F21Y 2105/18; F21Y 2115/10
See application file for complete search history.

(56) References Cited

U.S. PATENT DOCUMENTS

| | | | | |
|---|---|---|---|---|
| 9,581,323 | B2 * | 2/2017 | Shum | F21V 3/00 |
| 10,253,966 | B1 * | 4/2019 | Hanington | F21K 9/23 |
| 2016/0131310 | A1 * | 5/2016 | Lu | F21K 9/238 362/362 |
| 2018/0094778 | A1 * | 4/2018 | Sokol | F21V 23/04 |
| 2018/0202614 | A1 * | 7/2018 | Zhou | F21V 29/90 |
| 2019/0120474 | A1 * | 4/2019 | Cheng | F21K 9/238 |
| 2019/0242569 | A1 * | 8/2019 | Jiang | F21K 9/238 |
| 2019/0316741 | A1 * | 10/2019 | Chen | F21V 29/89 |

* cited by examiner

*Primary Examiner* — Zheng Song
(74) *Attorney, Agent, or Firm* — Maier & Maier, PLLC

(57) ABSTRACT

A high-power LED bulb, where the high-power LED bulb includes: a lamp holder with an accommodating groove and a mounting slot set with the accommodating groove at intervals; a driving power supply, which is set in the mounting slot; an insulating housing with wire hole, which is accommodated in the mounting slot and covered in the opening of the mounting slot; a luminous module installed in the accommodating groove, whose one end is electrically connected to the driving power supply through the wire hole; and a lamp cover, which is connected to the lamp holder and covered in the opening of the accommodating groove. The high-power LED bulb simplifies the structure of the high-power LED bulb and improves the safety of the high-power LED bulb.

9 Claims, 6 Drawing Sheets

HIGH-POWER LED BULB

CROSS-REFERENCE TO RELATED APPLICATIONS

This application claims the priority of Chinese Patent Application No. 201921819870.6 filed on Oct. 25, 2019, the disclosure of which is incorporated herein by reference.

TECHNICAL FIELD

The utility model relates to the field of lighting equipment, in particular to a high-power LED bulb.

BACKGROUND

When the high-power LED lamp works, the driving power supply of LED lamp emits light with the lamp panel and the lamp panel generates larger heat. Therefore, a radiator is required to radiate the heat of lamp panel. It is necessary to expose the radiator to facilitate heat dissipation. In general, in order to prevent the contact danger caused by the leakage of high-power LED bulb, it is necessary to use an isolated power supply at higher cost, or to use more insulated parts between the driving power supply and the radiator. As a result, the production cost of the high-power LED bulb is high, and the process is complicated.

The foregoing content is only used for assisting in understanding the technical scheme of the invention, but not mean the acknowledgement of that the above content is a prior art.

SUMMARY

The utility model mainly aims at providing a high-power LED bulb which can simplify the production process of the high-power LED bulb and reduce the production cost of the high-power LED bulb.

To achieve the above purpose, the high-power LED bulb proposed by the utility model comprises:

- a lamp holder with an accommodating groove and a mounting slot set with the accommodating groove at intervals;
- a driving power supply, which is set in the mounting slot;
- an insulating housing with wire hole, which is accommodated in the mounting slot and covered in the opening of the mounting slot;
- a luminous module installed in the accommodating groove, whose one end is electrically connected to the driving power supply through the wire hole; and
- a lamp cover, which is connected to the lamp holder and covered in the opening of the accommodating groove.

In one embodiment of the utility model, the lamp holder is provided with a plurality of heat dissipation holes that are connected to the accommodating groove;

- the lamp cover is provided with a plurality of air holes that are connected to the accommodating groove;
- the luminous module comprises a radiator and a lamp panel arranged in the accommodating groove. The lamp panel is electrically connected to the driving power supply and the lamp panel is arranged on one side of the lamp holder back to the radiator. The lamp panel is provided with a plurality of offsetting holes corresponding to a plurality of air holes. The connecting hole is provided with a plurality of offsetting holes corresponding to the radiator;

- a plurality of the heat dissipation holes, the air holes, the offsetting holes and the connecting holes are connected and form a heat dissipation channel.

In one embodiment of the utility model, the width (D) of the heat dissipation hole is D<6.5 mm; and/or the width (L) of the air hole is L<6.5 mm In one embodiment of the utility model, the lamp panel includes a plurality of ring-shaped light bars. The center of the radiator is center of circle. A plurality of the ring-shaped light bars are arranged in the same center of circle. The two adjacent the ring-shaped light bars are arranged at intervals to form a plurality of the offsetting holes.

In one embodiment of the utility model, a plurality of radiating ribs are convexly arranged on one side of the lamp panel back to the radiator that are radiated with the center of the radiator as the center of the circle.

In one embodiment of the utility model, the insulating housing forms an inclined surface towards one side of the driving power supply that inclines from the periphery of the insulating housing to the center of the insulating housing.

In one embodiment of the utility model, the lamp panel is provided with a plurality of LED lamp beads;

the lamp cover is provided with at least one accommodating space. The accommodating space is set with the air hole at intervals and is used to cover multiple LED lamp beads.

In one embodiment of the utility model, the lamp cover also comprises a plurality of ribs arranged on the air holes and a plurality of ribs are staggered and form a net structure.

In one embodiment of the utility model, the lamp holder comprises a connecting conductor and a lamp housing. The lamp housing is provided the accommodating groove, the mounting slot and the connecting hole. The connecting hole is connected to the bottom wall of the mounting slot and is set in taper hole;

- the connecting conductor is provided on the external surface of the lamp housing corresponding to the connecting hole. The connecting conductor is electrically connected to the driving power supply.

In one embodiment of the utility model, the high-power LED bulb also includes an external socket module which is electrically connected to the driving power supply. The external socket module is used to connect the power regulation module and the power regulation module is used to adjust the output power of the driving power supply.

In the technical scheme of the utility model, the mounting slot is set independent from the accommodating groove by setting the accommodating groove and the mounting slot set with the accommodating groove at intervals on the lamp holder and covering the opening of the mounting slot through the insulating housing; that is to say, the insulating housing and the mounting slot form an independent space. In this way, the driving power supply is provided in the independent space to achieve the independent setting of driving power supply and avoid the user's unintended touch. It can also avoid the use of the isolated power supply, reduce the production cost of high-power LED bulb, simplify the structure of high-power LED bulb and improve the use safety of high-power LED bulb. On the other hand, by setting the driving power supply in the mounting slot and setting the luminous module in the accommodating groove, and separating the driving power supply and the luminous module with the insulating housing, the high temperature produced by the luminous module will not influence the work of the driving power supply and the work stability of the high-power LED bulb will be increased.

BRIEF DESCRIPTION OF THE DRAWINGS

To better describe the technical schemes of the utility model or prior art, a brief introduction of drawings to be used in the descriptions of the embodiment or prior art is made hereby. Obviously, the drawings described below are only several embodiments of the utility model. For common technicians in this field, they can obtain other drawings based on these structures shown in the drawings without making additional creative endeavors.

Figure 1:
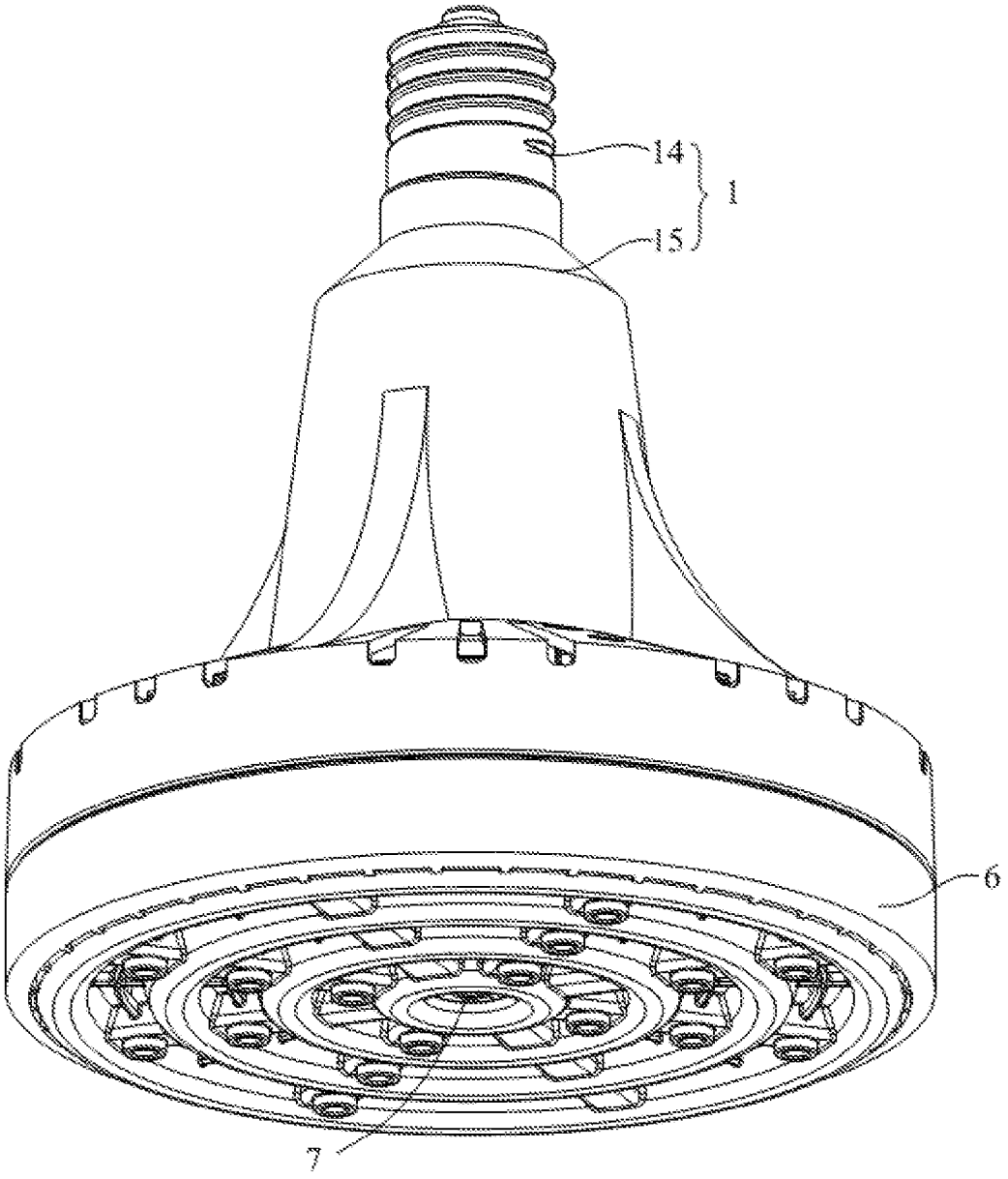
FIG. 1 is a structure diagram of an embodiment of high-power LED bulb of the utility model.

The implementation, functional characteristics and advantages of the utility model will be further illustrated hereinafter in conjunction with the embodiments and accompanying drawings.

DETAILED DESCRIPTION

A clear and complete description of the technical schemes combined with the drawing in utility model embodiments, this utility model embodiments clearly and completely describe the technical programs. Obviously, only some embodiments of this invention (instead of all the utility model embodiments) are described here. Based on the embodiment of the utility model, all other embodiments acquired by the common technicians in this field without creative work, shall be in the protection scope of this utility model.

It should be noted that, if there is a directional indication (upper, lower, left, right, front, and rear, etc.) in the embodiment of the utility model, the directional indication is only used to explain the relative positional relationship, motion condition, etc. between the components in a particular position (as shown in the drawing), and if the particular attitude is changed, the directional indication is changed accordingly.

In addition, if there are descriptions relating to "first", "second" and the like in embodiments of the utility model, such descriptions of "first", "second" and the like are for descriptive purposes only and are not to be construed as indicating or implying their relative importance or implying an indication of the number of indicated technical features. As such, a feature that defines as "first", "second" may explicitly or implicitly include at least one of that features. In addition, the "and/or" as stated in the whole text should be understood as there are three paralleled schemes where scheme A, or scheme B or scheme A and scheme B can be met at the same time (taking "A and/or B as an example"). In addition, the technical schemes of embodiments may be combined with each other, but must be available for common technicians in this field, and when the combination of the technical scheme is contradictory or impossible, it should be considered that the combination of the technical scheme does not exist and not fall within the scope of the utility model.

The utility model provides a high-power LED bulb. Understandably, the high-power LED bulb is a lighting device with LED lamp bead, which can emit light at higher power and produce higher heat. Refer to FIG. 1, it is a structure diagram of an embodiment of high-power LED bulb of the utility model; refer to FIG. 2, it is the structure diagram of another perspective of high-power LED bulb in FIG. 1; refer to FIG. 3, it is the structure diagram of the profile of the high-power LED bulb in FIG. 1; refer to FIG. 4, it is the structure diagram of the assembly structure of the high-power LED bulb in FIG. 1; refer to FIG. 5, it is the structure diagram of assembly structure of the luminous module in FIG. 4; refer to FIG. 6, it is a structure diagram of another embodiment of high-power LED bulb of the utility model.

In the Embodiment of the utility model, as shown in FIGS. 1, 2, 3 and 4, the high-power LED bulb includes: lamp holder 1, driving power supply 2, insulating housing 3, luminous module 4 and lamp cover 6; among them, driving power supply 2, insulating housing 3, luminous module 4 and lamp cover 6 are arranged on lamp holder 1. Understandably, lamp holder 1 includes connecting conductor 14 and lamp housing 15. Connecting conductor 14 is arranged on lamp housing 15 to connect the household power and driving power supply 2; that is to say, with connecting conductor 14 as the conductor, the household power is connected to driving power supply 2 to light luminous module 4. The specific assembly structure of high-power LED bulb is shown as follows:

lamp holder 1 is provided with accommodating groove 11 and mounting slot 12 that is set with accommodating groove 11 at intervals. Understandably, lamp holder 1 includes the lamp housing 15 and lamp housing 15 is an insulator. Optionally, lamp housing 15 may be plastic material, such as: polypropylene, polycarbonate, and polybutylene terephthalate; of course, lamp housing 15 may also be of ABS material (Acrylonitrile Butadiene Styrene). Under the premise that lamp housing 15 can be used to install driving power supply 2, insulating housing 3, luminous module 4 and lamp cover 6, the material is not limited here.

In one embodiment of the present application, driving power supply 2 is provided in mounting slot 12. Commonly, driving power supply 2 is used to convert the external power supply into a specific voltage and current to drive LED luminous power converter, usually: the input of driving power supply 2 may be high voltage power frequency alternating current, low voltage direct current, high voltage direct current, low voltage high frequency alternating current, etc.

In one embodiment of the present application, insulating housing 3 is accommodated in mounting slot 12 and covered in the opening of mounting slot 12. Insulating housing 3 is provided with wire hole 31; optionally, insulating housing 3 may be organic insulation material or inorganic insulation material.

In one embodiment of the present application, insulating housing 3 is of the same material as lamp housing 15.

Optionally, insulating housing 3 and lamp holder 1 may be installed by the bolt. Alternatively, insulating housing 3 and lamp holder 1 are provided with a mounting hole (not shown in the figure). Insulating housing 3 drives through the mounting hole with bolt and is installed with lamp holder 1.

Optionally, insulating housing 3 can also be held in mounting slot 12. When luminous module 4 is set in accommodating groove 11, luminous module 4 is arranged with insulating housing 3 to cover the opening of mounting slot 12.

In one embodiment of the present application, luminous module 4 is installed in accommodating groove 11, whose one end is electrically connected to driving power supply 2 through wire hole 31; luminous module 4 includes lamp panel 43 on which two leads are arranged, through which the two lamp panels 43 are connected to the power output positive pole and the negative pole on driving power supply 2, respectively. Among them, lamp panel 43 includes multiple LED lamp beads 41. That is to say, lamp panel 43 can emit at least one kind of light. Under the premise that lamp panel 43 can emit light, the specific type of lamp panel 43 is not limited here.

In one embodiment of the present application, lamp cover 6 is connected to lamp holder 1 and covers the opening of accommodating groove 11. Understandably, lamp cover is of transparent or translucent materials. Under the premise that lamp cover 6 can export light, the material of lamp cover 6 is not limited here.

Optionally, lamp cover 6 is of insulation material.

Optionally, to facilitate the installation of lamp cover 6 and lamp holder 1, lamp cover 6 may be provided with a structure compatible with the inner wall of accommodating groove 11. For example: lamp cover 6 may be provided with a fastening part (not shown in the figure) and the inner wall of accommodating groove 11 may be provided with a buckle placement part (not shown in the figure). Lamp cover 6 is set in accommodating groove 11 through the matching of fastening part and buckle placement part.

Optionally, to facilitate the installation of lamp cover 6 and lamp holder 1, lamp cover 6 may be provided with an avoidance hole (not shown in the figure). The inner wall of accommodating groove 11 is provided with the pin column (not shown in the figure). Lamp cover 6 is firmly connected to the pin column through the avoidance hole, so that lamp cover 6 is installed in accommodating groove 11.

Optionally, in order to increase the range of the light radiation of high-power LED bulb, partial structure of the lamp cover 6 can be extruded from accommodating groove 11 so as to increase the refraction and scattering effect of lamp cover 6 on the light.

In the present embodiment, mounting slot 12 is set independent from accommodating groove 11 by setting accommodating groove 11 and mounting slot 12 set with accommodating groove 11 at intervals on lamp holder 1 and covering the opening of mounting slot 12 through insulating housing 3; that is to say, the insulating housing 3 and the mounting slot 12 form an independent space. In this way, the driving power supply 2 is provided in the independent space to achieve the independent setting of driving power supply 2 and avoid the user's unintended touch. It can also avoid the use of the isolated power supply, reduce the production cost of high-power LED bulb, simplify the structure of high-power LED bulb and improve the use safety of high-power LED bulb. On the other hand, by setting the driving power supply 2 in the mounting slot 12 and setting the luminous module 4 in the accommodating groove 11, and separating the driving power supply 2 and the luminous module 4 with the insulating housing 3, the high temperature produced by the luminous module 4 will not influence the work of the driving power supply 2 and the work stability of the high-power LED bulb will be increased.

In one embodiment of the utility model, lamp holder 1 is provided with a plurality of heat dissipation holes 17 that are connected to accommodating groove 11. That is to say to increase the heat dissipation effect, multiple heat dissipation holes 17 are opened on lamp holder 1. Multiple heat dissipation holes 17 are connected to accommodating groove 11 to blow air from heat dissipation hole 17 to lamp holder 1 and take away the heat produced by luminous module 4.

Optionally, lamp holder 1 is set in circular truncated cone. A number of heat dissipation holes 17 are centered on the central axis of lamp holder 1 and arranged radially.

Optionally, lamp holder 1 can also be irregularly shaped.

Figure 2:
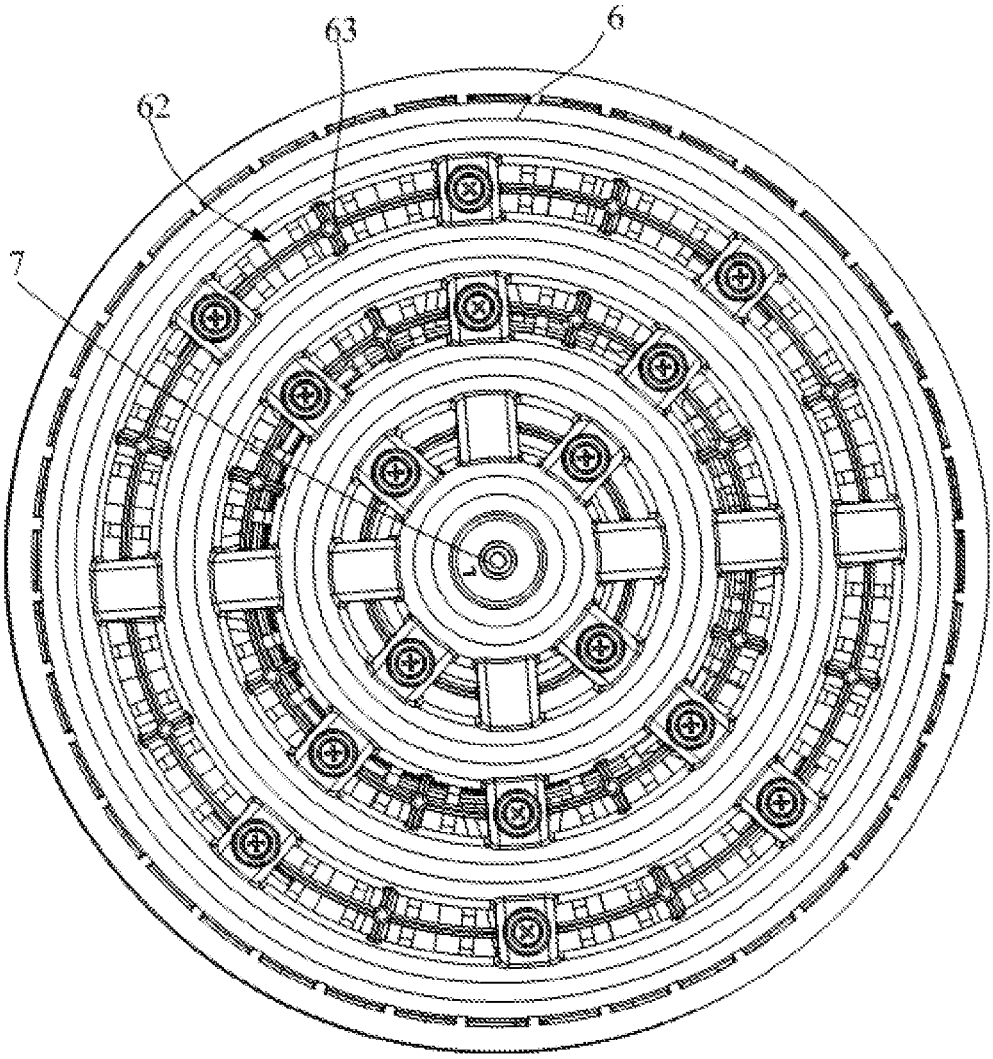
FIG. 2 is the structure diagram of another perspective of high-power LED bulb in FIG. 1.

In one embodiment of the utility model, as shown in FIG. 2, lamp cover 6 is provided with multiple air holes 62 that are connected to accommodating groove 11. Optionally, multiple air holes 62 are set on lamp cover 6 in any arrangement mode.

Figure 5:
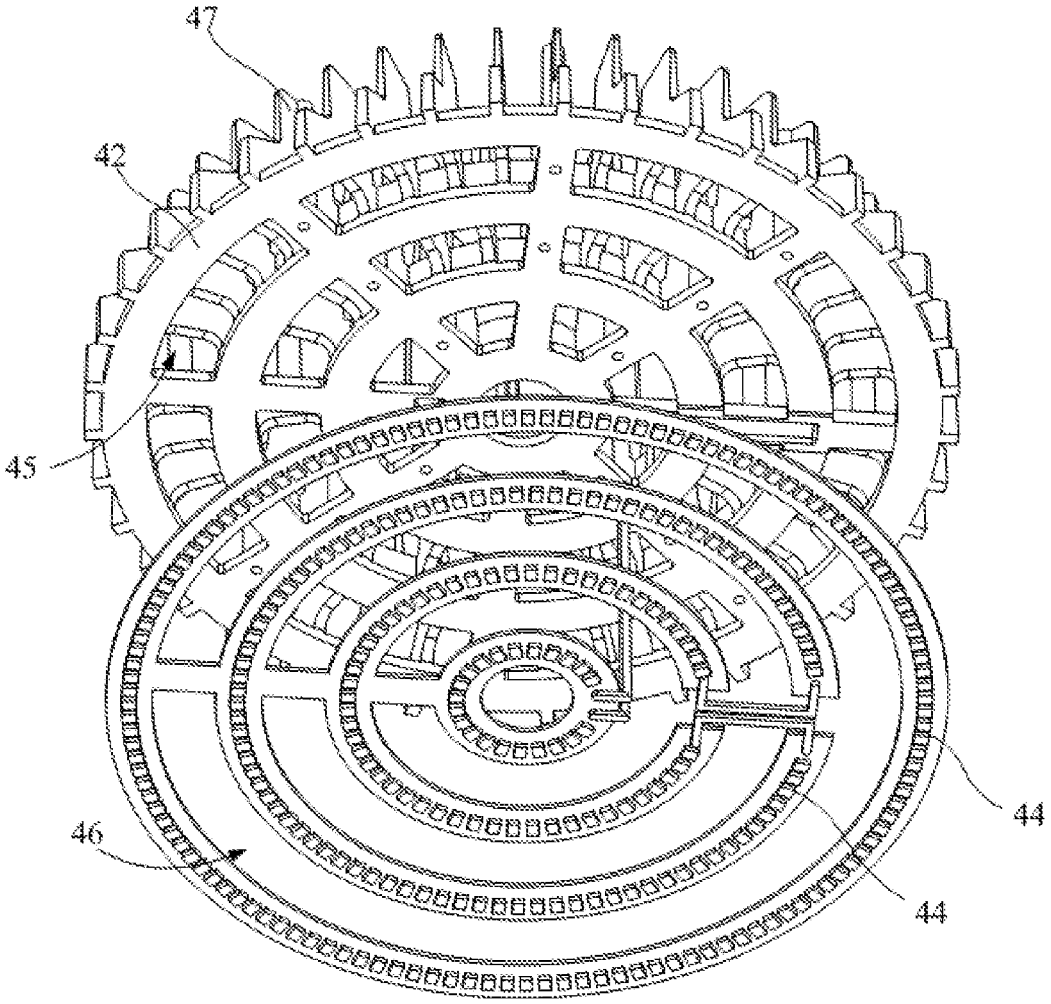
FIG. 5 is the structure diagram of assembly structure of the luminous module in FIG. 4.

In one embodiment of the utility model, as shown in FIG. 5, luminous module 4 comprises radiator 42 and lamp panel 43 arranged in accommodating groove 11. The lamp panel 43 is electrically connected to driving power supply 2 and lamp panel 43 is arranged on one side of lamp holder 1 back to the radiator 42. The lamp panel 43 is provided with a plurality of offsetting holes 46 corresponding to a plurality of air holes 62. The connecting hole 45 is provided in a plurality of offsetting holes 46 corresponding to the radiator 42. That is to say, connecting hole 45 is corresponding to offsetting hole 46 to facilitate the air flow.

Optionally, to facilitate the installation of radiator 42, radiator 42 may be provided with multiple positioning holes (not shown in the figure). The bottom wall of accommodating groove 11 is provided with multiple pin columns (not shown in the figure). Radiator 42 is firmly connected to the pin column through the bolt passing through the positioning hole.

Optionally, the pin column is provided with a threaded hole.

In the present embodiment, a plurality of heat dissipation holes 17, air holes 62, offsetting holes 46 and connecting holes 45 are connected and form a heat dissipation channel That is to say, the air may be blown into accommodating groove 11 from multiple heat dissipation holes 17 and achieve the heat exchange with radiator 42 in accommodating groove 11, and be blown out via multiple offsetting holes 46 and connecting holes 45; and/or, the air may be blown into accommodating groove 11 from multiple air holes 62 and achieve the heat exchange with radiator 42 in accommodating groove 11, and be blown out via multiple offsetting holes 46 and heat dissipation hole 17.

Optionally, radiator 42 is of aluminum alloy material.

In the present embodiment, a plurality of heat dissipation holes 17, air holes 62, offsetting holes 46 and connecting holes 45 are conduced and form a heat dissipation channel by providing multiple heat dissipation holes 17 on lamp holder 1, providing multiple air holes 62 on lamp cover 6, providing multiple offsetting holes 46 on lamp panel 43 corresponding to multiple air holes 62 and providing multiple connecting holes 45 on radiator 42 corresponding to multiple offsetting holes 46, in order to enhance the convection of air and improve the heat dissipation effect of high-power LED bulb.

In one embodiment of the utility model, the width (D) of the heat dissipation hole 17 is $D<6.5$ mm; the width of heat dissipation hole 17 is less than 6.5 mm to prevent the standard test finger from extending into accommodating groove 11.

In one embodiment of the utility model, the width (L) of the air hole 62 is $L<6.5$ mm. The width of air hole 62 is less than 6.5 mm to prevent the standard test finger from extending into accommodating groove 11.

Understandably, standard test finger refers to the test tool used to test the electric shock performance of lamps. The size and dimension can be found in the relevant standards, such as IEC61032 standard. It can further reduce the size of heat dissipation hole 17 and air hole 62, improve the anti-shock level of the product so that it can be used into a lower non-isolated power supply.

In one embodiment of the utility model, as shown in FIG. 5, lamp panel 43 includes a plurality of ring-shaped light bars 44. The center of the radiator 42 is center of circle. A plurality of ring-shaped light bars 44 are arranged in the same center of circle. The two adjacent ring-shaped light bars 44 are arranged at intervals so as to form a plurality of the offsetting holes 46. Understandably, a plurality of ring-shaped light bars 44 may be the first light bar (not identified in the figure), the second light bar (not identified in the figure), the third light bar (not identified in the figure) and the fourth light bar (not identified in the figure). The first light bar, the second light bar, the third light bar and the fourth light bar are ring-shaped light bars. In order to arrange the first light bar, the second light bar, the third light bar and the fourth light bar centering on radiator 42, the radius of the first light bar is less than that of the second light bar, the radius of the second light bar is less than that of the third light bar, the radius of the third light bar is less than that of the fourth light bar.

Optionally, the first light bar, the second light bar, the third light bar and the fourth light bar are connected to each other.

In the practical application of the Embodiment, a whole piece of circuit board may be cut to lamp panel 43. That is to say, a whole piece of circuit board may be cut to two lamp panels 43 through pressing and cutting to save the raw materials.

Figure 4:
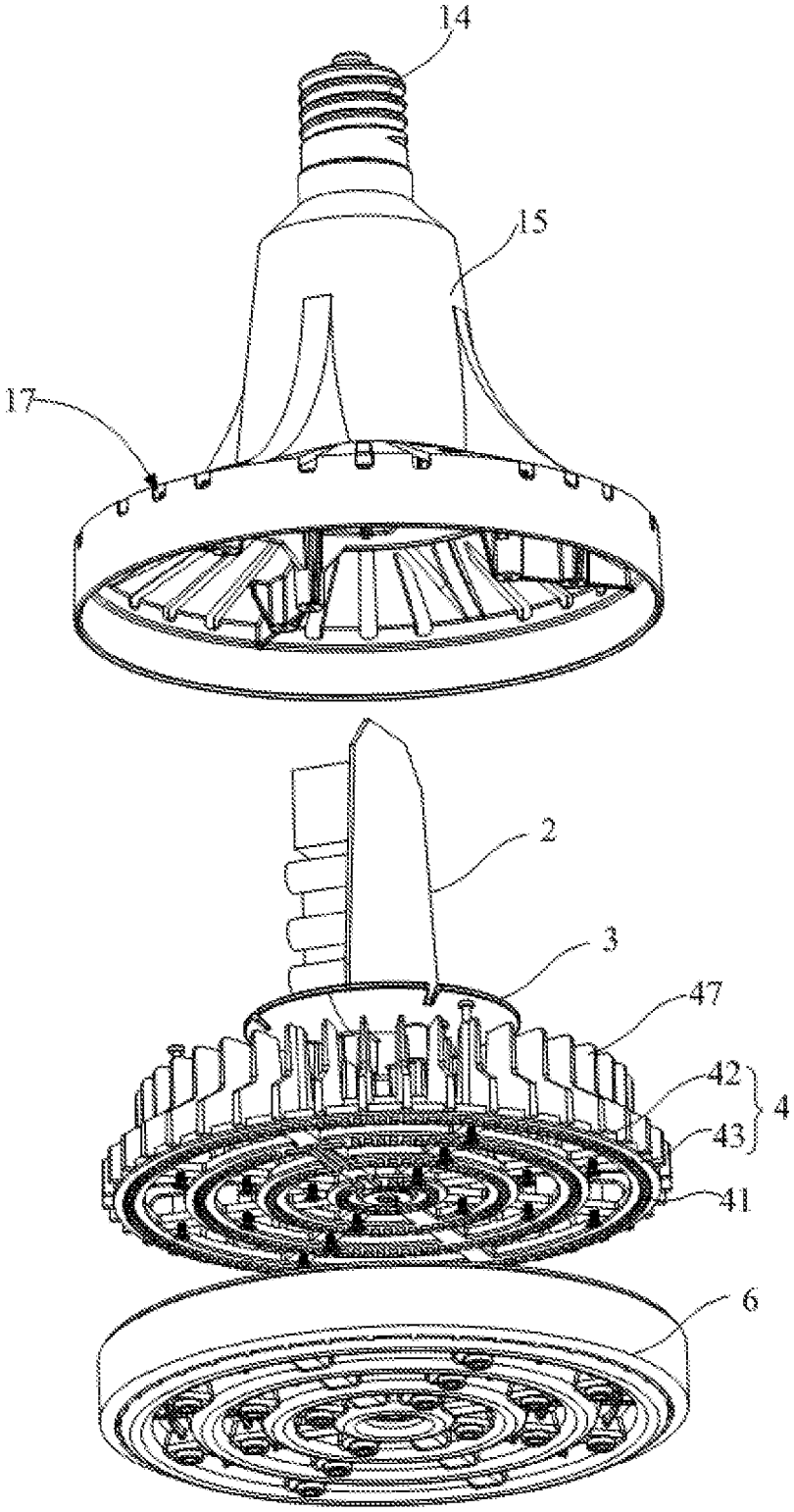
FIG. 4 is the structure diagram of assembly structure of high-power LED bulb in FIG. 1.

In one embodiment of the utility model, as shown in FIGS. 4 and 5, a plurality of radiating ribs 47 are convexly arranged on one side of the back lamp panel 43 to the radiator 42 that are radiated with the center of the radiator 42 as the center of the circle. Understandably, a plurality of radiating ribs 47 are convexly arranged on radiator 42 to form a plurality of offsetting slot space (not identified in the figure), in order to blow the air from offsetting space and enhance the heat dissipation effect. That is, the radiator 42 is hollowed out.

In the present embodiment, a plurality of radiating rib 47 and radiator 42 are melted and cast in one.

In one embodiment of the utility model, the insulating housing 3 forms an inclined surface 33 towards one side of the driving power supply 2 that incline surface 33 from the periphery of the insulating housing 3 to the center of the insulating housing 3.

In the present embodiment, one side of insulating housing 3 is provided with inclined plane 33, which can guide the air to wire hole 31 and improve the heat dissipation performance.

Optionally, the air outlet (not shown in the figure) is provided on insulating housing 3 to increase the air flow.

Figure 3:
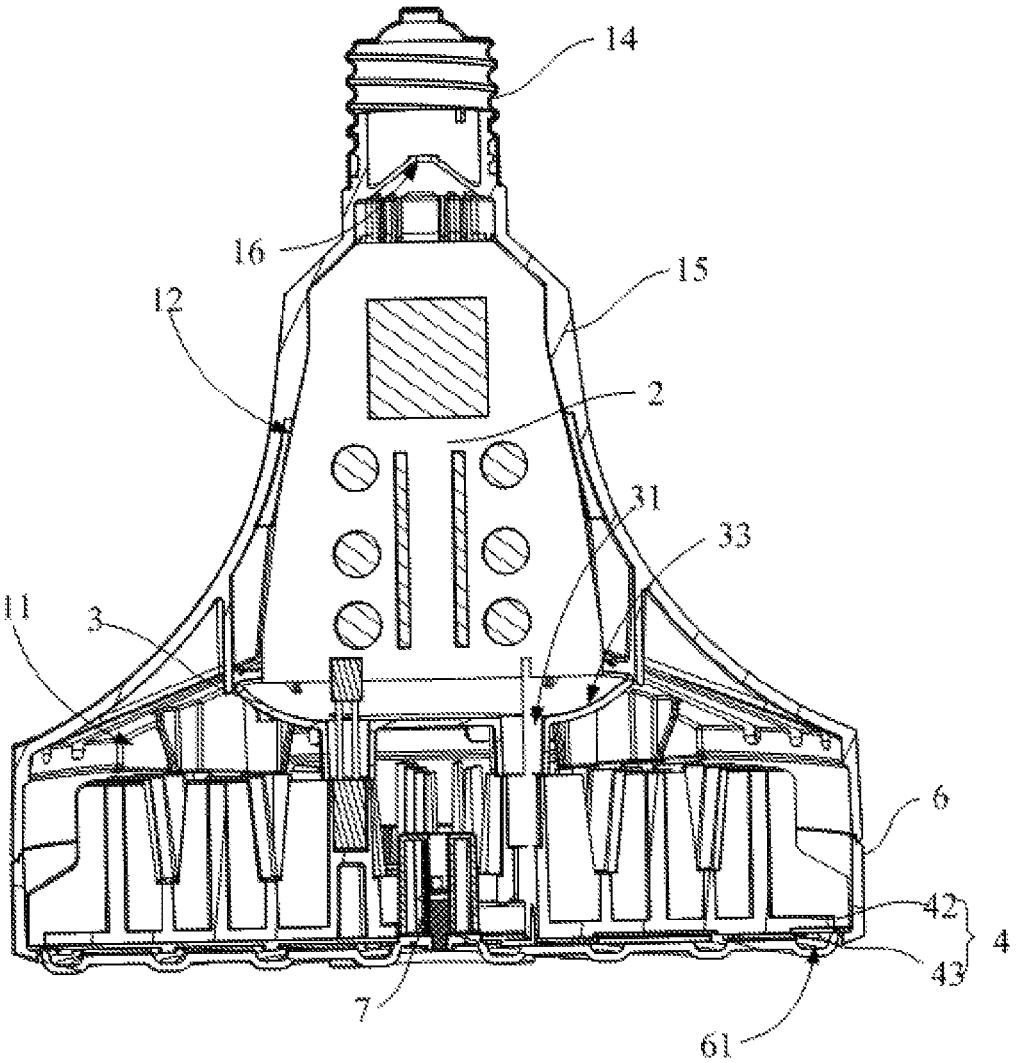
FIG. 3 is the structure diagram of profile of high-power LED bulb in FIG. 1.

In one embodiment of the utility model, as shown in FIG. 3, lamp panel 43 is provided with a plurality of LED lamp beads 41; the lamp cover 6 is provided with at least one accommodating space 61. The accommodating space 61 is set with the air hole 62 at intervals and is used to cover multiple LED lamp beads 41. Understandably, the avoidance space 61 may be a slot cavity structure composed of a transparent material; that is to say, hot pressing lamp cover 6 faces to one side of lamp panel 43, so that lamp cover 6 faces one side of lamp panel 43 and forms at least one accommodating space 61. When lamp panel 43 fits to lamp cover 6, lamp cover 6 fits to lamp panel 43, so that the opening of accommodating space 61 fits closely to lamp panel 43 and accommodating space 61 covers multiple LED lamp beads 41.

In the present embodiment, by covering multiple LED lamp beads 41 through lamp cover 6, accommodating space 61 is used to refract and scatter the light produced by LED lamp bead to improve the luminous efficiency; at the same time, the inner wall corresponding to accommodating space 61 and the lamp panel 43 forms an independent space to prevent the entry of insect and other objects to LED lamp bead 41 and avoid the influence of the product performance.

In one embodiment of the utility model, as shown in FIG. 2, lamp cover 6 also comprises a plurality of ribs 63 arranged on the air holes 62 and a plurality of ribs 63 are staggered and form a net structure.

In the present embodiment, the net structure formed on each air hole 62 can prevent the users from inserting fingers into lamp cover 6 and improve the safety performance of high-power LED bulb. At the same time, a plurality of ribs 63 is staggered and form a net structure to prevent rib 63 from shading the light.

In one embodiment of the utility model, the lamp holder 1 comprises connecting conductor 14 and lamp housing 15. The lamp housing 15 is provided with accommodating groove 11, mounting slot 12 and connecting hole 16. The connecting hole 16 is connected to the bottom wall of mounting slot 12 and is set in taper hole. By adopting the structure in which the connecting hole 16 is conical, that is to say, the inner wall of wire hole 31 is set at a certain tilt angle, so that the conductor can pass through wire hole 31 and improve the installation efficiency of high-power LED bulb.

The connecting conductor 14 is provided on the external surface of lamp housing 15 corresponding to the connecting hole 16. The connecting conductor 14 is electrically connected to the driving power supply 2. Understandably, connecting conductor 14 is set on the external surface of lamp housing 15, so that the end of connecting conductor 14 away from lamp housing 15 forms the first contact end (not identified in the figure) and the end of connecting conductor 14 close to lamp housing 15 forms the second contact end (not identified in the figure). The first contact end and the second contact end are electrically connected to driving power supply 2, respectively.

Figure 6:
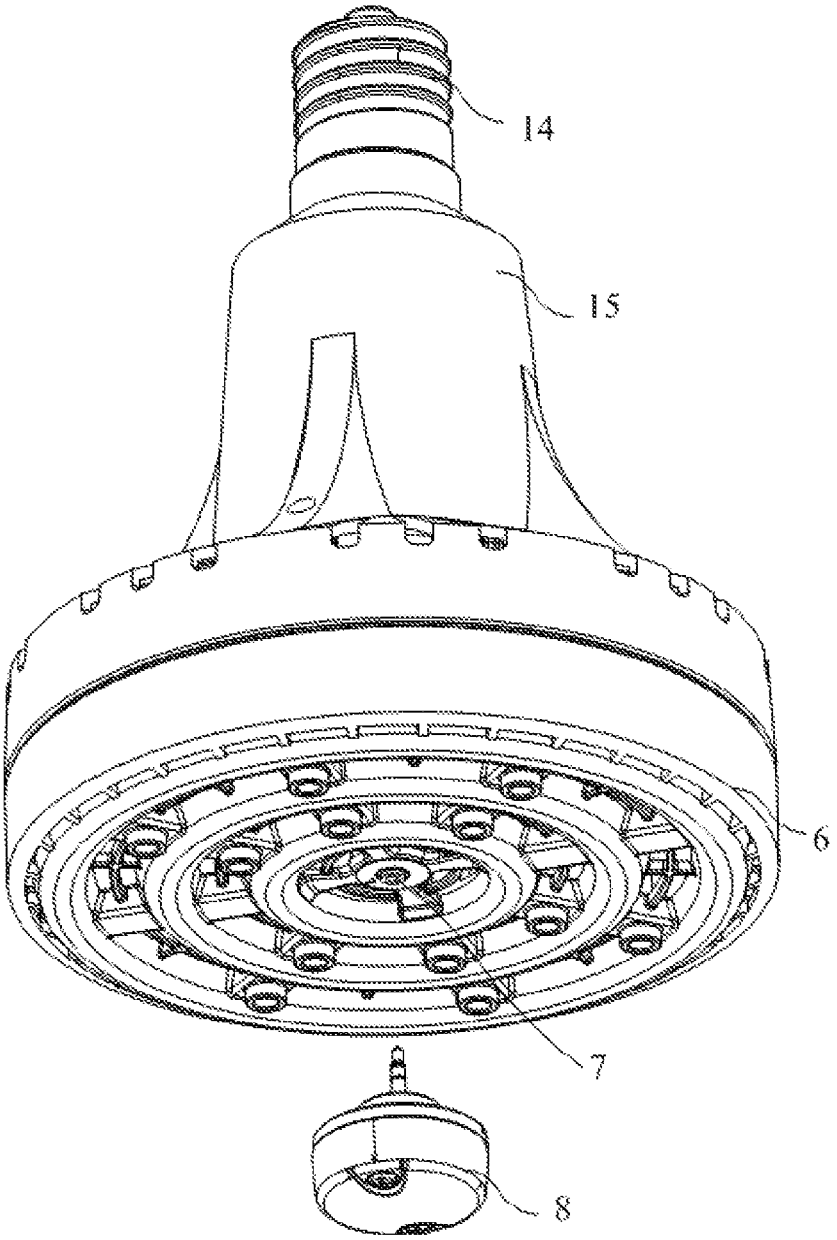
FIG. 6 is a structure diagram of another embodiment of high-power LED bulb of the utility model.

In one embodiment of the utility model, as shown in FIGS. 3 and 6, high-power LED bulb also includes an external socket module 7 which is electrically connected to driving power supply 2. The external socket module 7 is used to connect the power regulation module 8 and the power regulation module 8 is used to adjust the output power of the driving power supply 2. Power regulation module 8 is used to input rated electric frequency or current. Power regulation module 8 is connected to the circuit of driving power supply 2 through external socket module 7 to adjust the current outputted by driving power supply 2 by inputting the specific frequency or current to driving power supply 2.

Understandably, driving power supply 2 is provided with the power regulating chip. When the power regulation module 8 is inserted into external socket module 7, the power regulating chip is connected. Power regulation module 8 inputs specific frequency or current to power regulating chip, so that the power regulating chip adjusts the output voltage of driving power supply 2.

Optionally, to facilitate the installation of power regulation module 8, an installation space may be provided in the middle of radiator 42 (not identified in the figure). The corresponding installation space of lamp cover 6 is provided with an insertion hole (not identified in the figure). External socket module 7 is set on radiator 42 and located in the installation space.

In one embodiment of the utility model, external socket module 7 is headphone interface. Understandably, headphone interfaces can be headphone interfaces of any specification, such as: interface of 2.5 mm or 3.5 mm; of course, the external socket module 7 may also be a serial bus interface.

In one embodiment of the utility model, external socket module 7 is mobile phone charging interface; understandably, there are three common interfaces of mobile phone charging plug, namely Micro USB interface, USB Type C interface and Lightning interface.

In one embodiment of the utility model, external socket module 7 is RJ45 interface, namely the common type of communication lead-end connection interface;

in one embodiment of the utility model, external socket module 7 is the USB interface (serial bus interface).

Power regulation module 8 is provided with a connecting plug (not identified in the figure) that is matched with external socket module 7.

Optionally, power regulation module 8 is used to transmit pulse-width modulated signal, resistance change signal and 0-10V current signal to driving power supply 2.

The description is only the preferred embodiment of the utility model, and it is not for this reason that the patent scope of the utility model is limited. Any equivalent structural transformation made by using the description of the utility model and the drawing, or direct/indirect application in other related innovation fields under the inventive concept of the utility model, is included in the patent protection scope of the utility model.

What is claimed is:

1. A high-power LED bulb, comprising:

a lamp holder with an accommodating groove and a mounting slot which creates a sealed cavity and is set with the accommodating groove at intervals;

a driving power supply, which is set in the mounting slot;

an insulating housing with a wire hole, which is accommodated in the mounting slot and covered in an opening of the mounting slot;

a luminous module installed in the accommodating grooves, one end of which is electrically connected to the driving power supply through the wire hole, the luminous power module comprising a radiator and a lamp panel arranged in the accommodating groove, the lamp panel is electrically connected to the driving power supply and the lamp panel is arranged on one side of the lamp holder with its back directly connected to the radiator, the lamp panel is provided with a plurality of offsetting holes corresponding to a plurality of air holes, a connecting hole is provided with the plurality of offsetting holes corresponding to the radiator;

a lamp cover, which is connected to the lamp holder and covered in the opening of the accommodating groove and has the plurality of air holes that are connected to the accommodating groove; and a plurality of the heat dissipation holes, wherein the plurality of heat dissipation holes, the air holes, the offsetting holes, and the connecting holes are connected and form a heat dissipation channel.

2. The high-power LED bulb as in claim 1, wherein the width (D) of the heat dissipation hole is D<6.5 mm; and/or the width (L) of the air hole is L<6.5 mm.

3. The high-power LED bulb as in claim 2, wherein the lamp panel includes a plurality of ring-shaped light bars, the center of the radiator is a center of a circle, and the plurality of the ring-shaped light bars are arranged in the same center of the circle wherein adjacent light bars are arranged at intervals to form the plurality of the offsetting holes.

4. The high-power LED bulb as in claim 1, wherein a plurality of radiating ribs are convexly arranged on one side of the lamp panel back to the radiator that are radiated with the center of the radiator as the center of circle.

5. The high-power LED bulb as in claim 1, wherein the insulating housing forms an arc towards one side of the driving power supply that arcs from the periphery of the insulating housing to the center of the insulating housing.

6. The high-power LED bulb as in claim 1, wherein the lamp panel is provided with a plurality of LED lamp beads; the lamp cover is provided with at least one accommodating space, the accommodating space is set with the air holes at intervals and used to cover multiple LED lamp beads.

7. The high-power LED bulb as in claim 1, wherein the lamp cover also comprises a plurality of ribs arranged on the air holes and the plurality of ribs are staggered and form a net structure.

8. The high-power LED bulb as in claim 1, wherein the lamp holder comprises a connecting conductor and a lamp housing, the lamp housing is provided the accommodating groove, the mounting slot and the connecting hole, the connecting hole is connected to the bottom wall of the mounting slot and is set in a tapered hole; and the connecting conductor is provided on an external surface of the lamp housing corresponding to the connecting hole, the connecting conductor is electrically connected to the driving power supply.

9. The high-power LED bulb as in claim 1, wherein the high-power LED bulb also includes an external socket module which is electrically connected to the driving power supply, the external socket module is used to connect a power regulation module and the power regulation module is used to adjust the output power of the driving power supply.

* * * * *